US005217124A

United States Patent [19]

Stone

[11] Patent Number: 5,217,124

[45] Date of Patent: Jun. 8, 1993

[54] CLIP-ON DIVIDER DEVICE FOR SUPPORTING AND ORGANIZING OBJECTS ON A SHELF

[75] Inventor: John W. Stone, Evergreen, Colo.

[73] Assignee: CelTech Manufacturing Corp., Evergreen, Colo.

[21] Appl. No.: 886,791

[22] Filed: May 19, 1992

[51] Int. Cl.[5] ..... A47F 5/00

[52] U.S. Cl. ..... 211/184; 211/43; 108/61

[58] Field of Search ..... 211/43, 184; 108/60, 108/61

[56] References Cited

U.S. PATENT DOCUMENTS

| | | | |
|---|---|---|---|
| 767,037 | 8/1904 | Brett | 108/61 |
| 989,566 | 4/1911 | Callaghan | 211/184 X |
| 1,675,269 | 6/1928 | Hine | 211/184 X |
| 2,884,139 | 4/1959 | Dunham | 211/184 |
| 3,285,429 | 11/1966 | Propst | 211/43 |
| 3,601,258 | 8/1971 | Stein | 211/184 |
| 4,327,838 | 5/1982 | Cooke | 211/184 |
| 4,512,480 | 4/1985 | Evenson | 211/184 X |
| 4,735,324 | 4/1988 | Wilcek | 211/184 |

FOREIGN PATENT DOCUMENTS

| | | | |
|---|---|---|---|
| 1435596 | 3/1966 | France | 211/184 |

OTHER PUBLICATIONS

*Gaylord*, 1991, p. 27.
*Gaylord* 1990 *Reference Catalog*, pp. 34–35.
*Demco*, 1990, pp. 15–18.
*Highsmith*, Catalog L31, Aug. 1990–Jul. 1991, p. 67.

*Primary Examiner*—Gibson, Jr.: Robert W.
*Attorney, Agent, or Firm*—Timothy J. Martin; Dana S. Rewoldt

[57] ABSTRACT

A shelf divider adapted to support and organize objects located on the shelf. The shelf divider includes an upper and a lower web portion adapted to be positioned against the exposed edges surface of the shelf, a base plate extending perpendicularly from the upper web and a clamp arm extending from the lower web in opposed relation to the base plate. The clamp arm is movable between a closed position and an open position. The clamp arm is biased toward the closed position so that, when in the mounted state, the clamps free-end portion bears against the lower surface of the shelf. The base plate has connected to it a relatively flat divider panel. The divider panel is adapted to have sides which are in facing relationship with the objects of the shelf. Further, the divider panel includes stiffening ribs on each side of the divider panel. The stiffening ribs project outwardly from the divider plane to resist deflection of the divider panel when it is mounted on the shelf.

17 Claims, 6 Drawing Sheets

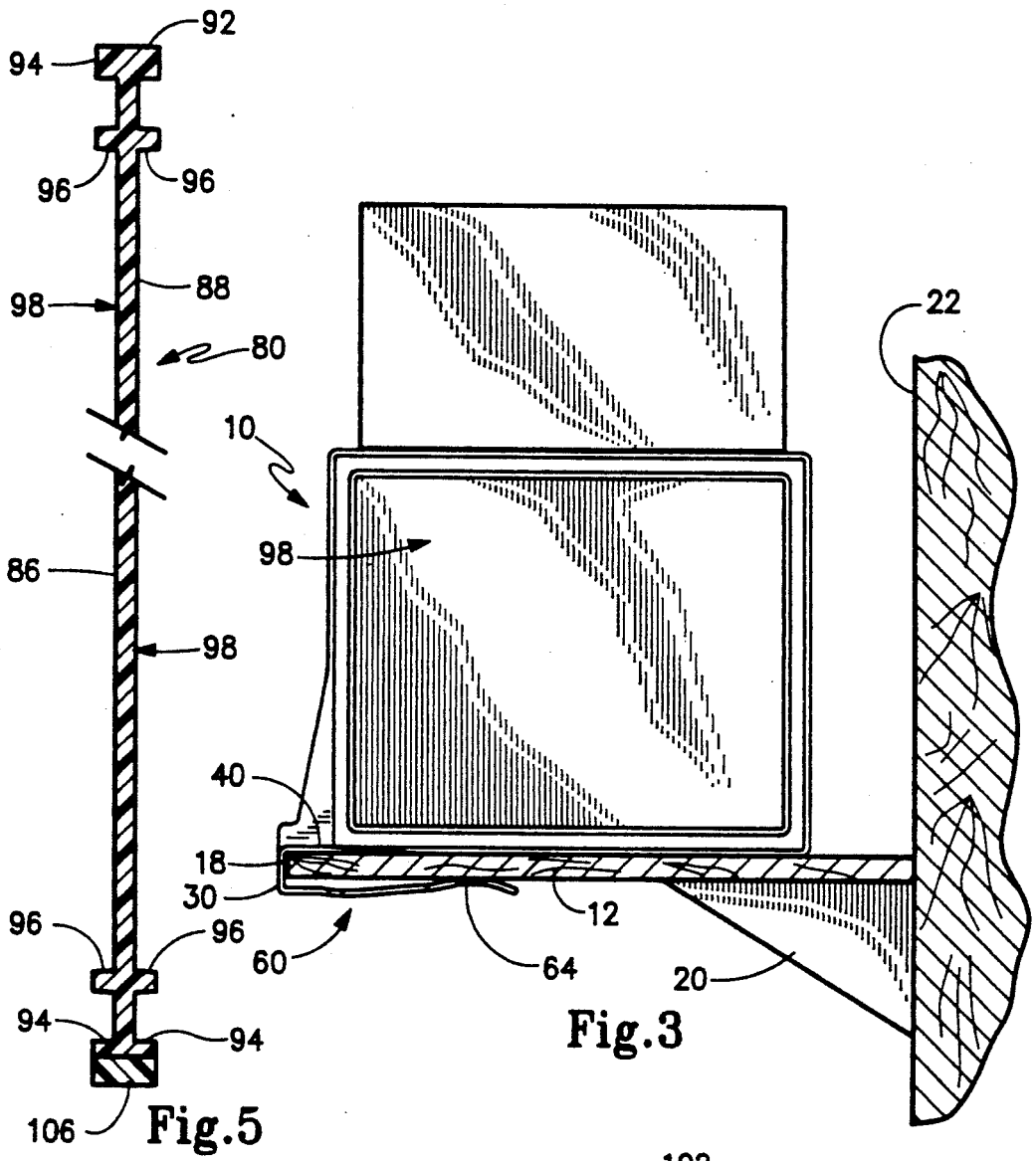
Fig.3
Fig.5
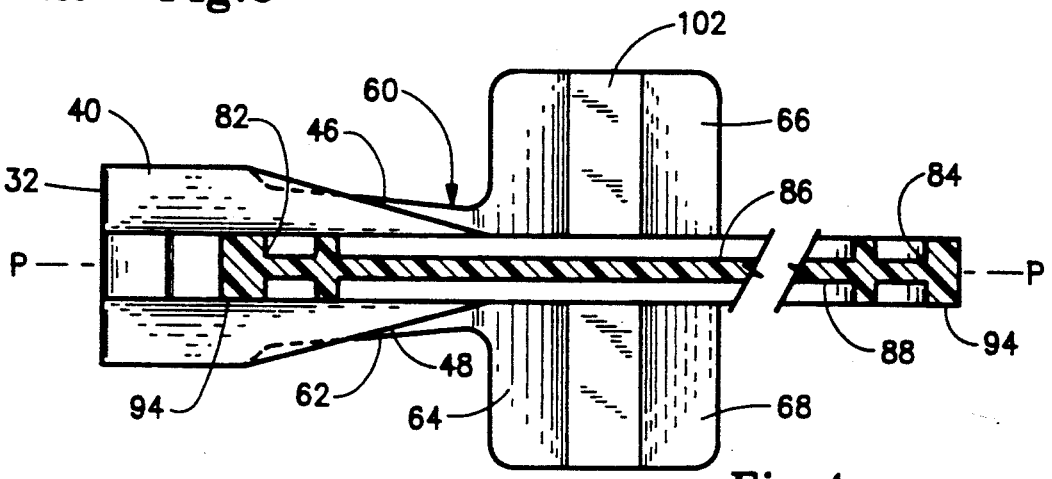
Fig.4

CLIP-ON DIVIDER DEVICE FOR SUPPORTING AND ORGANIZING OBJECTS ON A SHELF

FIELD OF THE INVENTION

The present invention generally relates to devices used in conjunction with book shelves in order to organize and support objects filed on those shelves. Specifically, however, the present invention is directed to clip-on devices which can be used as bookends, book shelf and cataloging dividers.

BACKGROUND OF THE INVENTION

Books and other literary materials are often stored or filed on a raise of shelving. A variety of bookends or book supports have heretofore been provided for laterally supporting books on a shelf. Typically, bookends have evolved as either heavy, end pieces whose very weight is sufficient to support a row of books in an upright position or as some form of lever structure which has a portion that underlies the books so that the weight of books at the end of a row will hold the remaining books in an upright position. Among these lever-type constructs is the commonly utilized bookend in the form of a metal, T-shaped support which has a base portion in the form of a tongue that is slide under the endmost group of books of a row of books and which has connected thereto an upright support which is perpendicular to the tongue. This upright support bears against the outside cover of the book in order to keep the endmost books from falling over, and thus each book, in turn, supports an adjacent book.

Several problems exists with the T-shaped bookend. For instance, if this bookend is not positioned squarely against the books, it is not able to support the row in an upright position. Thus, if a book is removed from a row of books, the bookend must be repositioned squarely against the endmost book, or the remaining books will tend to slide and tip the book end. Another problem experienced with this type of bookend is a problem referred to as "knifing". Knifing occurs when a book is carelessly reshelved and the exposed closed pages of the book are forced against the upright portion of the bookend. Since the upright support is relatively thin, the upright support will knife through the book and fold and even possibly tear the pages.

In response to the problems with T-shaped bookends, a clip-on bookend was developed and is subject of U.S. Pat. No. 4,327,838 issued May 4, 1982 to Cooke. In this structure, a clip-on bookend is provided that is an integral construction of two portions—a base portion and a book support portion. The base portion is formed with an integral resilient clip section for releasably securing the support portion to a book shelf. The support portion is in the form of a closed, loop-shaped structure having a flat bottom wall that rests on the top surface of the book shelf and front, rear and top sides which have lateral edges that can bear against a row of books. Accordingly, the book support portion of the clip-on bookend described in this patent has a substantial width in the direction of the width of the shelf in order to provide structural rigidity as well as to prevent knifing of the books. While it is possible that the clip-on bookends described in U.S. Pat. No. 4,327,838 can be used as book shelf dividers, that is, as a device adapted to be interpositioned between two books in order to separate those books for organizational purposes, the substantial width is inefficient and, where small objects, such as computer disks, are to be stored, the open region surrounded by the book support portion may allow the objects to fall therethrough or otherwise become skewed. Furthermore, although some open shelving system and some file cabinet systems provided divider panels, these panels are typically thin metal plates with limited adjustably since they mount only at specific attachment stations. Here, again, these dividers do not eliminate the knifing problem.

Accordingly, there is a need for a clip-on divider device which may mount to a shelf and serve not only as a bookend but also, if desired, as a divider between materials in a row. Further, there is a need for such a divider that is thin enough to have structural rigidity but which is wide enough to avoid the knifinq problem discussed above. There is still a further need for a clip-on divider that does not rely upon the weight of the materials approximate thereto in order to lateral support the row of materials.

SUMMARY OF THE INVENTION

It is an object of the present invention is to provide a new and useful clip-on divider which may mount to a shelf in order to support books and other materials thereon.

It is another object of the present invention is to provide a clip-on divider panel which may be used as an interior divider or as a bookend in order to organize and ensemble materials on a bookshelf.

Another object of the present invention is to provide a clip-on divider which has a minimized width in order to efficiently organize materials on a shelf yet which is constructed to be sufficiently rigid to laterally support the materials so organized.

Yet another object of the present invention is to provide a clip-on divider which retro-fits onto an existing shelf and which is selectively adjustable along the width of the shelf without requiring special attachment stations.

It is still a further object of the present invention to provide a relatively inexpensive clip-on divider panel of one-piece molded construction of a plastic material and which is configured to have a minimum width without sacrificing structural stability.

To accomplish these objects, a shelf divider is provided according to the present invention with this shelf divider being adapted to mount on a standard shelf that has an upper surface, a lower surface, an exposed edge surface, such as the front edge of the shelf of a bookcase. The shelf divider according to the present invention is operative when in the mounted state to support and organize objects located on the shelf. Broadly, this shelf divider includes a web portion that is adapted to be positioned against the exposed edge surface of the shelf when in the mounted state so as to have an upper and lower web edge and a web width along the exposed edge surface of the shelf. A base plate extends from the upper web edge perpendicularly to the web portion and has a bottom surface adapted to rest on the upper surface of the shelf. A clamp arm extends from the lower web edge in opposed relation to the base plate. This clamp arm terminates in a free-end portion, and the clamp arm is movable between a closed position wherein the free-end portion is proximate to the base plate to an open position wherein the free-end portion is spaced from the base plate. A relatively flat divider panel is connected to the top surface of the base plate and is located centrally thereof. The divider panel extends perpendicularly to the base plate and defines a divider plane that is perpendicular to the web portion. Accordingly, the divider panel has a peripheral edge and a pair of opposite side surfaces which will face objects placed on the shelf. At least one stiffening rib is integrally formed on each side surface of the divider panel and projects outwardly from the divider plane in order to strengthen the divider panel thereby resisting deflection of the divider panel when in the mounted state. The shelf divider is formed of a plastic material that has some resiliency so that the clamp arm is biased toward the closed position so that the clamp arm resiliently clamps a portion of the shelf between the free-end and the base plate when the divider panel is mounted on the shelf.

Preferably, the base plate according to the present invention is tapered in thickness as measured between the top and bottom surfaces thereof. In one embodiment, the base plate has a pair of side edges that converge toward one another and terminate along a lowermost edge portion of the divider panel proximate the free-end portion of the clamp arm when the free-end portion is in the closed position. Alternately, the side edges may converge towards one another and terminate proximate to a rearward edge portion of the divider panel so that the base plate extends substantially along the entire lowermost portion of the divider panel. In yet another alternate embodiment, the base plate has side edges that are symmetric about the divider panel and the base plate diminishes in thickness in a direction from the divider panel to each of the side edges. For example, the base plate and the later construction may be rectangular in shape and extend completely along a lowermost portion of the divider panel completely from the forward edge portion to the rearward edge portion thereof.

In one embodiment of the present invention, a first stiffening rib extends completely around the periphery of the divider panel, and, if desired, a second stiffening rib may extend around the margin of the divider panel in spaced-apart relation to the first stiffening rib, on each side surface of the divider panel, so that the second stiffening ribs each bound an uninterrupted side surface area for the divider panel. Alternately, the stiffening ribs may be formed as X-shaped configurations or in other configurations known in the art. To further stiffen the divider panel, a nose portion located proximate to the web portion may have an increased thickness, and this thickness may correspond in magnitude to the combined thicknesses of the divider panel and the first and second stiffening ribs.

If desired, a lowermost portion of the divider panel, which may include a portion of the base plate, is provided with a pad of anti-skid material, such as a urethane foam pad, to increase the friction between the shelf and the divider panel when in the mounted state. Likewise, a pad of anti-skid material may be located on the free-end portion of the clamp arm so that this pad is positioned to contact the lower surface of the shelf when in the mounted state. The two pads of anti-skid material help stabilize the divider panel when in the mounted state. To further stabilize the divider panel in the mounted state, the clamp arm includes a pair of laterally projecting wing portions on the free-end thereof so that these wing portions project oppositely one another on either side of the divider plane. Thus, the free-end portion has a width that is greater than the width of the web portion as measured in a direction perpendicular to the divider plane. Furthermore, the clamp arm may have a first arm portion proximate to the web portion that has a positive radius of curvature and the free-end portion may be provided with a negative radius of curvature, each as measured with respect to the base plate, so that the clamp arm has a flattened S-shaped configuration. This configuration helps supply a clamping force to the shelf when the divider panel is placed in the mounted state.

Finally, the present invention includes the use of a clip-on divider or bookend, such as provided as described above, in conjunction with a shelf system that has a pair of side panels, a back panel and an open front and which is provided with one or more shelves that extend from the front toward the back panel but which terminate short of the back panel to leave a gap between an exposed rear edge surface of the shelf and the back panel. This gap is sized to allow the clamp arm and web portion to be manipulated so that the web portion may mount against the rear edge surface of a shelf with the divider panel extending forwardly of the rear edge. This helps present a clean appearance without having the clip structure located on the forward edge surface of the shelf yet maintains the advantages of the present invention. Furthermore, such a shelving system, in conjunction with a divider panel described above, makes it more difficult to remove the shelf dividers and accordingly decreases the likelihood of theft.

These and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 3 is end view in elevation of the right end of the ensemble of books shown in FIG. 3 along with the endmost shelf divider in a mounted state;

FIG. 4 is a cross-sectional view taken about lines 4—4 of FIG. 1;

FIG. 5 is a cross-sectional view taken about lines 5—5 of FIG. 1;

DETAILED DESCRIPTION OF THE PREFERRED EMBODIMENT

The present invention is directed to support devices for supporting books and other materials, such as catalogs, computer disks, manuals, papers, etc., on a shelf in an organized manner. While the present invention contemplates use as a bookend, the present invention is especially directed to providing a shelf divider that can separate an ensemble of materials into different arrays so that it may be interposed in the materials. Furthermore, the present invention when used as a shelf divider, is constructed so as to be sufficiently strong to support the materials dimensioned to prevent knifing when the materials are placed on the shelf. To this end, the present invention is directed to a new and useful shelf divider that maximized the efficiency of a shelf organizational system.

Figure 1:
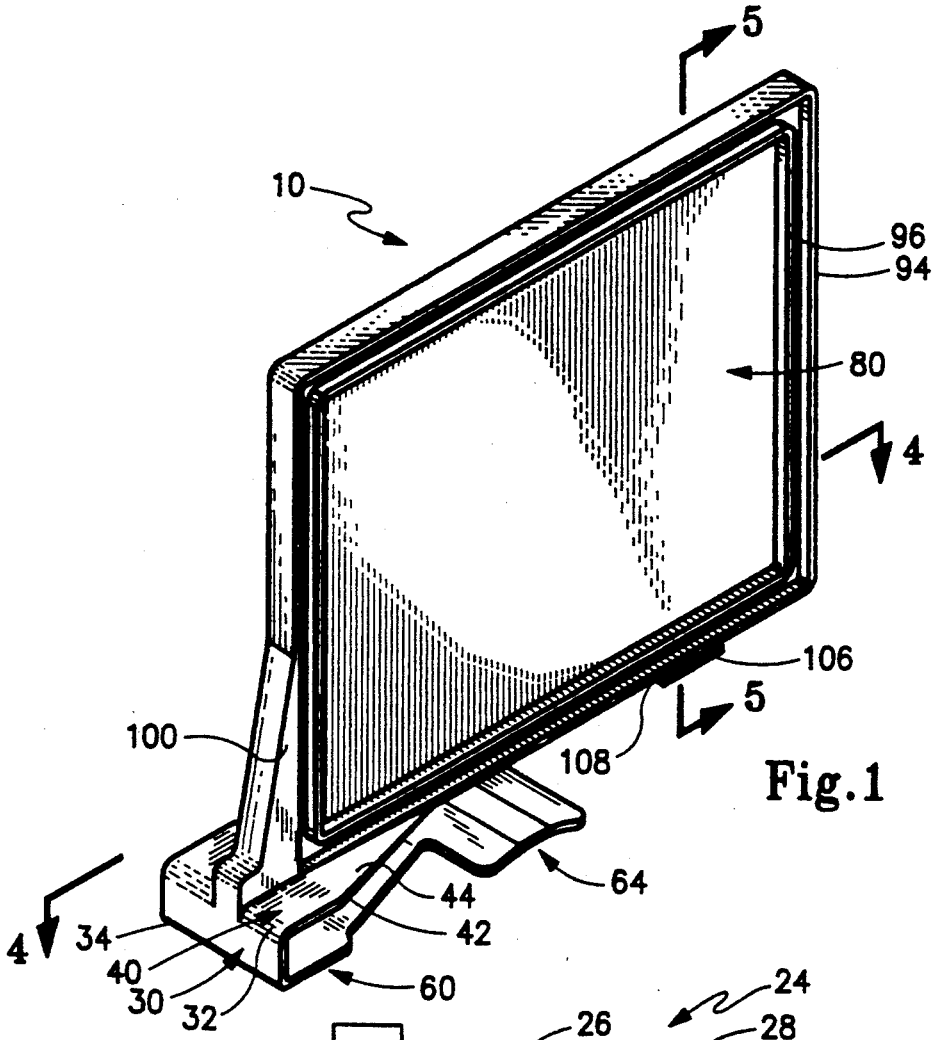
FIG. 1 is a perspective view of a shelf divider according to a first exemplary embodiment of the present invention.
Figure 2:
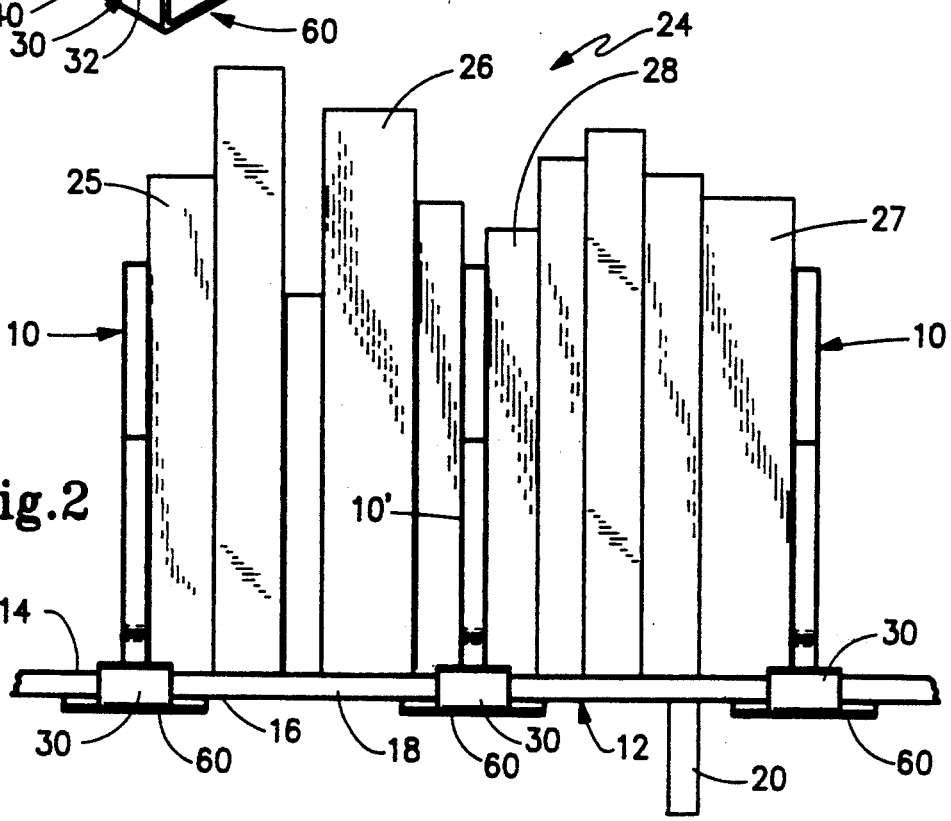
FIG. 2 is a front view, in elevation, showing three shelf dividers according to the first exemplary embodiment of the present invention mounted on a shelf and supporting an, ensemble of books.

Accordingly, a first exemplary embodiment of the present invention is shown in FIGS. 1–6. FIG. 1 shows a perspective view of shelf divider 10 while FIGS. 2 and 3 show a plurality of shelf dividers 10 in use. As is seen in FIGS. 2 and 3, an ensemble of books 24 are supported on either side by a pair of shelf dividers 10, which act as bookends for books 25 and 27, respectively, while a third shelf divider 10' acts as a divider between books 26 and 28 of ensemble 24. Shelf dividers 10 and 10' are mounted against an exposed edge in the form of front edge surface 18 of shelf 12 that is supported on wall 22 by a bracket 20. Shelf 12 includes an upper surface 14, on which the ensemble of books 24 rests, and a lower surface 16 opposite upper surface 14. With reference to FIGS. 1–3, it may be seen that shelf divider 10 broadly includes a web portion 30, a base plate 40, an clamp arm 60 and a divider panel 80, the structure of each being is described more thoroughly below. These portions of shelf divider 10 are all preferably formed as an integral one-piece molded plastic construction. However, it should be understood that materials other than plastic, such as metal, may be employed for the construction of shelf divider 10.

Specifically, with respect to web portion 30, it may be seen that web portion 30 is rectangular in shape and has an upper web edge 32 and a lower web edge 34. Web portion 30, as is shown in FIG. 2 and 3, is adapted t abut against exposed front edge surface 24 of shelf 12 and has a width sufficient to help stabilize shelf divider 10 thereon. To this end, shelf divider 10 is clamped onto shelf 12 by the resilient clamping interaction by base plate 40 and clamp arm 60.

Figure 6:
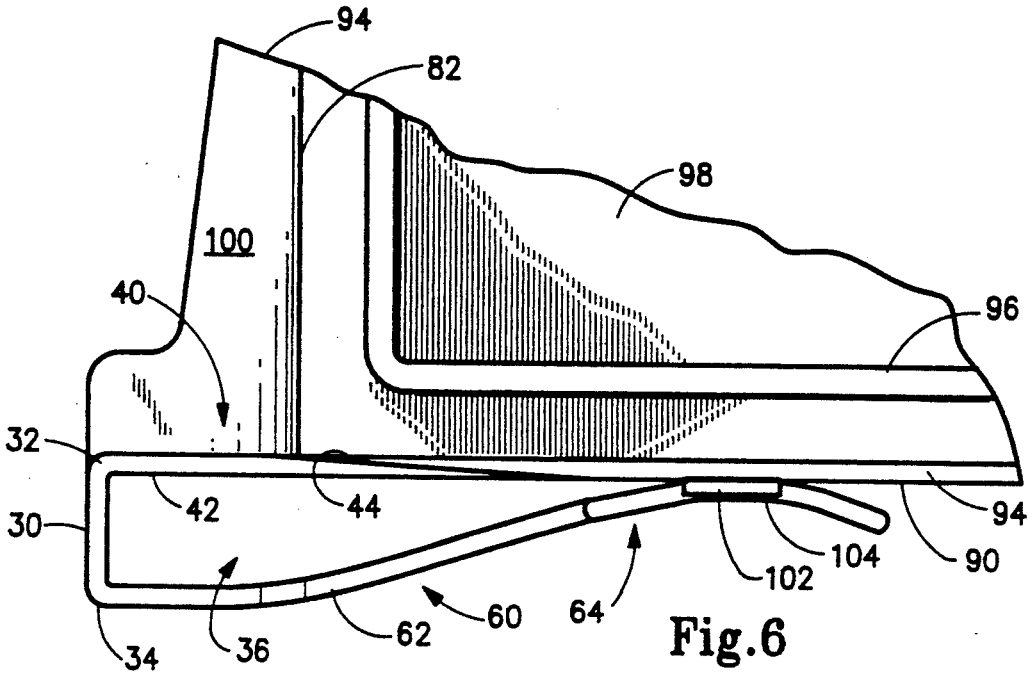
FIG. 6 is a side view in elevation of the clamp arm and nose,/portion of the shelf divider shown in FIGS. 1-3.

With reference again to FIG. 1 but also to FIGS. 4 and 6, it may be seen that base plate 40 extends along upper web edge 32 to form a line of intersection with web portion 30. Base plate 40 extends from upper web edge 32 perpendicularly to web portion 30 and has a bottom surface 42 adapted to rest on upper surface 14 of shelf 12, as is shown in FIGS. 2 and 3. Base plate 40 has a top surface 44 opposite bottom surface 42, clamp arm 60 is opposed to base plate 40 and extends from lower web edge 34 to terminate in a free-end portion 64. Clamp arm 60 has a clamp arm portion 62 between free-end portion 64 and lower web edge 34. Accordingly, an open region 36 is created between clamp arms 60 and base plate 40.

Base plate 40 has a pair of side edges 46 and 48 which converge toward one another, as is shown in FIGS. 1 and 4, and side edges 46, 48 terminate proximate to said free-end portion 64 when clamp arm 60 is in the closed position, as is shown in FIG. 1. Furthermore, as is best shown in FIG. 6, the thickness of base plate 40, as measured between bottom and top surfaces 42, 44 tapers. This allows base plate 40 to be easily inserted underneath the books which it divides or supports, for example, books 25–28 in FIG. 2. Furthermore, this tapering thickness does not tend to skew the orientation of the ensemble of books as would happen if a thicker base plate were employed.

As noted above, clamp arm 60 in FIG. 1 is shown in the closed position, and clamp arm 60 is shown in the open position in FIG. 3. In the open position, shelf 12 may be received in open region 36 so that shelf divider 10 may be advanced to abut web portion 30 against exposed front edge surface 18. Since shelf divider 10 is formed, preferably, of a stiff yet resilient plastic material, clamp arm 60 is normally biased into the closed position. Thus, when clamp arm 60 is released, a margin of shelf 12 adjacent front edge surface 18 is resiliently clamped between free-end portion 64 and base plate 40. To this end, as is shown in FIG. 6, arm portion 62 of clamp arm 60 has a positive radius of curvature measured with respect to base plate 40 while free-end portion 64 has a negative radius of curvature measured with respect to base plate 40. Accordingly, clamp arm 60 appears with a flattened S-shaped configuration and this configuration aids in the resilient clamping of shelf 12 between base plate 40 and clamp arm 60. Further, to assist in the stabilization of shelf divider 10 on a shelf 12, free-end portion 64 includes a pair of lateral wing portions 66 and 68 which project equidistantly on either side of a divider plane "P", as is shown in FIG. 4. As discussed below, divider plane P is the plane defined by the divider panel 80, and this plane is oriented perpendicularly to a respective shelf on which it is mounted. Accordingly, free-end portion 64 of clamp arm 60 has a width that is greater than the width of web portion 30 as measured in a direction perpendicular to the divider plane.

Divider panel 80 is best shown in FIGS. 1 and 3–6. Here it may be seen that divider panel 80 is relatively flat and is connected to and located centrally of base plate 40 so that it extends upwardly perpendicularly to the base plate 40 and thus defines divider plane P that is perpendicular to web portion 30. Divider panel 80 has a forward edge portion 82, a rearward edge portion 84 and a pair of opposite side surfaces 86 and 88. Further, divider panel 80 has a lowermost edge portion 90 which extends along shelf 12 when in the mounted state and which is co-extensive with base plate 40; divider panel 80 has an uppermost edge portion 92 opposite edge portion 90. Accordingly, edge portions 82, 84, 90 and 92 define a periphery for divider panel 80.

In order to help and rigidify divider panel 80, one or more upstanding stiffening ribs are provided on each of side surfaces 86 and 88 with each of the stiffening ribs being integrally formed with the divider panel 80 and projecting outwardly from the divider plane. Therefore, as is shown in FIGS. 4 and 5, a first stiffening rib 94 extends around the periphery of divider panel 80 and, at a region proximate base plate 40 is thickened to form a solid nose 100 for shelf divider 10. A second stiffening rib 96 is positioned on each of side surfaces 86 and 88 of divider panel 80 and is inset to be spaced-apart from its respective first stiffening rib 94. Each of second stiffening ribs 96 is in a closed loop that surrounds an uninterrupted side surface area 98. Side surface area 98 may be conveniently used for marking, indexing or other informational purposes.

In operation, shelf divider 10 is placed on a shelf 12 by first moving clamp arm 60 from the closed position shown in FIGS. 1 and 6 to the open position shown in FIG. 3 by deflecting clamp arm 60 away from base plate 40 and the lowermost edge portion 90 of divider panel 80. Shelf 12 is then slid into open region 36, and clamp arm 60 is released. Shelf divider 10 may be maneuvered until web portion 30 abuts an exposed edge surface, such as front edge surface 18, and shelf divider 10 thereby becomes clamped between base plate 40 and clamp arm 60. Lateral wings 66 and 68 help stabilize shelf divider 10 so that divider panel 80 is perpendicular to both edge surface 18 and shelf 12. Stiffening ribs 94 and 96 shelf rigidify divider panel 80.

As is shown in FIGS. 4–6, dislodgment of shelf divider 10 is further prevented by the inclusion of anti-skid pads on free-end 64 of clamp arm 60 and on lowermost edge portion 90 of divider panel 80. With reference to FIGS. 4 and 6, it may be seen that a first pad 102 is mounted in a channel 104 formed in free-end portion 64 transversely to divider plane P, and pad 102 may be secured therein in any convenient manner, such as by a suitable adhesive. Pad 102 has a thickness sufficient to initially contact lower surface 16 of a shelf 12 when shelf divider 10 is placed thereon. Similarly, a second pad 106 is shown in FIG. 1 and 5 and is mounted in a channel 108 formed transversely along lowermost edge portion 90 transversely to divider plane P. Again, pad 106 has a thickness so that it initially contacts the upper surface 14 of shelf 12 proximate rearward edge portion 94 of divider panel 80 when shelf divider 10 is mounted thereon. Pads 102 and 106 may be formed of any suitable plastic foam material or other such material known in the art. One such example that has been found suitable is a urethane foam. It is important that the material of pads 102 and 106 are such to frictionally grip, respectively, surfaces 16 and 14.

Figure 7:
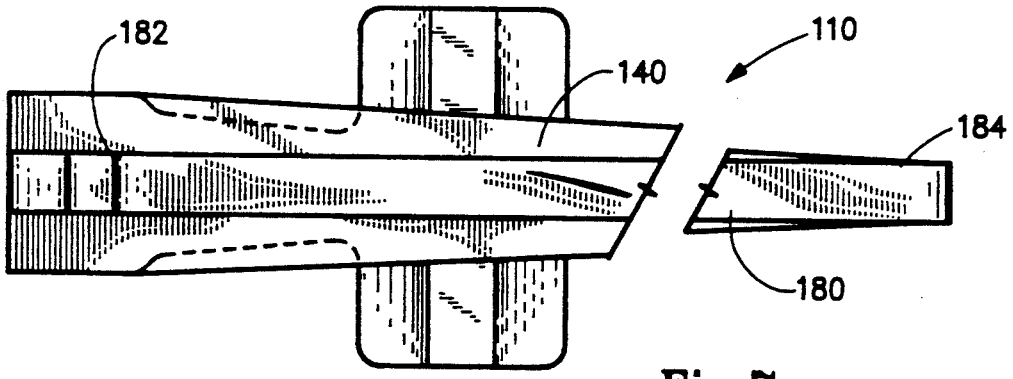
FIG. 7 is a top plane view, partially broken-away of a first alternate embodiment of the present invention showing a modification to the base plate structure.

A first alternate embodiment of the present invention is shown in FIG. 7 wherein shelf divider 110 is structured substantially the same as shelf divider 10 with the exception that base plate 140 is elongated towards rearward edge portion 184 of divider panel 180 so that base plate 140 extends completely from forward edge portion 182 of divider panel 180 to rearward edge portion 184. In all other respects, the construction shown in FIG. 7 is identical as that shown in FIGS. 1–6, and it should be again appreciated that the thickness of base plate 140 tapers, but more gradually than the taper shown with respect to base plate 40 in FIG. 6.

Figure 8:
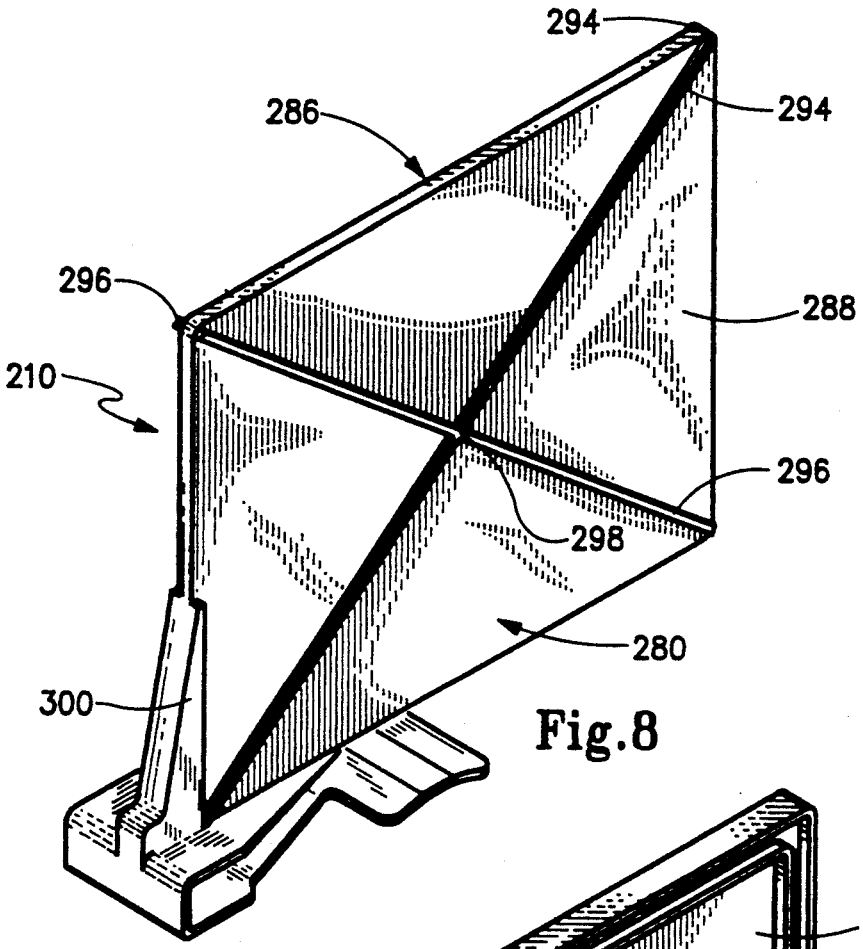
FIG. 8 is a perspective view of a second alternate embodiment of the present invention showing a modified stiffening rib structure.
Figure 9:
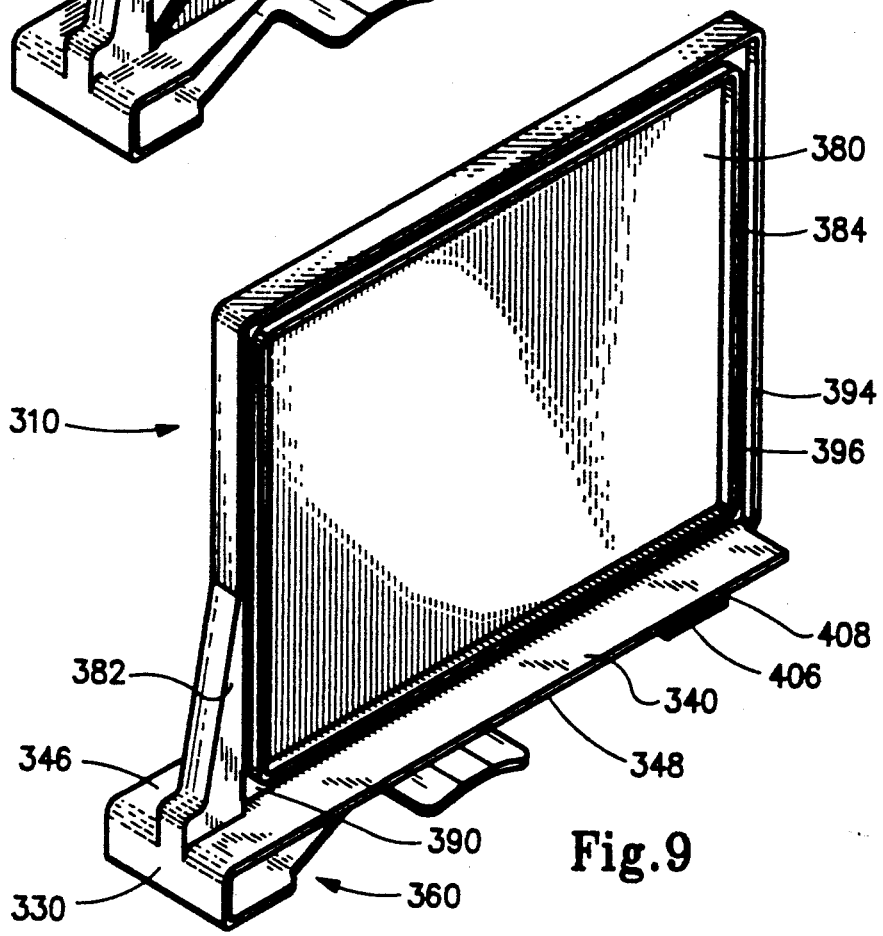
FIG. 9 is a perspective view of a third alternate embodiment of the present invention again showing another modified base plate.
Figure 10:
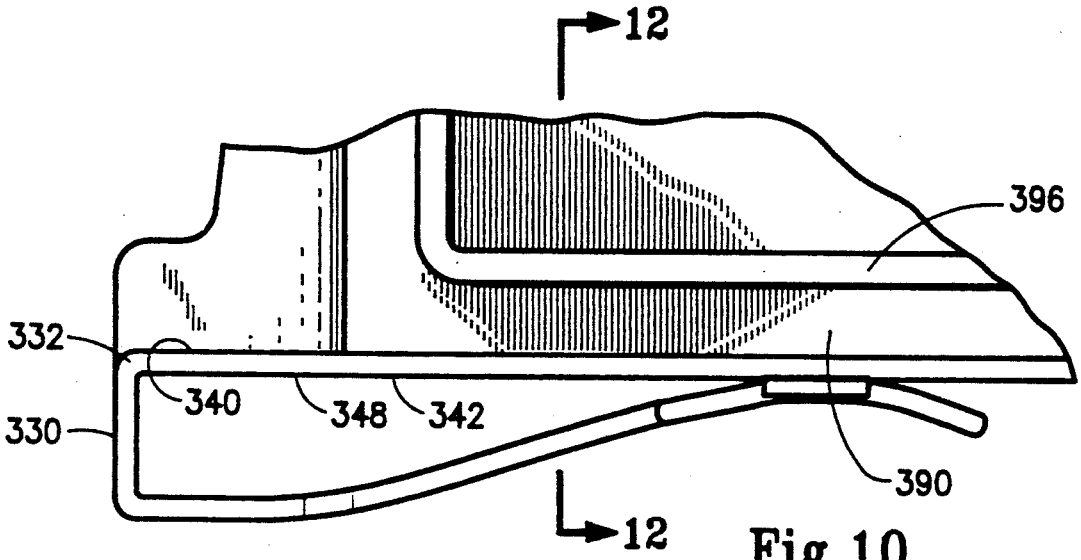
FIG. 10 is an enlarged side view in elevation showing the clamp arm and nose portion of the alternate embodiment of FIG. 9.

A second alternate embodiment of the present invention is shown in FIG. 8 wherein shelf divider 210 is shown having a modified stiffening rib structure. In FIG. 8, thickened nose portion 300 is provided, but peripheral ribs 94 and 96, shown in FIGS. 1–6, are eliminated in favor of stiffening ribs 294 and 296 formed on each side surface 286 and 288 of divider panel 280. Each pair of stiffening ribs 294 and 296 intersect one another at a mid-portion of a respective side surface 286, 288 such as mid-portion 298 shown in FIG. 8. Again, in all other respects, though, the structure of shelf divider 210 is the same as that described with respect to shelf divider 10.

A third alternative embodiment of the present invention is shown in FIGS. 9–12. Here, shelf divider 310 has a divider panel 380 that is structured the same as divider panel 80 described with respect to the first exemplary embodiment. Web portion 330 and clamp arm 360 are also identical with web portion 30 and clamp arm 60 described with respect to the first exemplary embodiment. However, in FIGS. 9–12, the structure of the base plate 340 has been modified from that described with respect to base plate 40. As is shown in these figures, therefore, base plate 340 has a pair of side edges 346 and 348 which are substantially parallel to one another instead of converging. Furthermore, base plate 340 extends completely from upper web edge 332 of web portion 330 to rearward edge portion 384 of divider panel 380. Thus, base plate 340 extends completely from forward portion 382 of divider 380 to rearward edge portion 384. With this construction, the portion of the first stiffening rib is eliminated along lowermost edge pertain 390 of divider panel 380, but first stiffening rib 394 extends around the remainder of the periphery of divider panel 380. Second stiffening rib 396 is provided and is inset or spaced-apart with respect to rib portion 394, and is inset or spaced-apart with respect to base plate 340 along lowermost edge portion 390.

Figure 11:
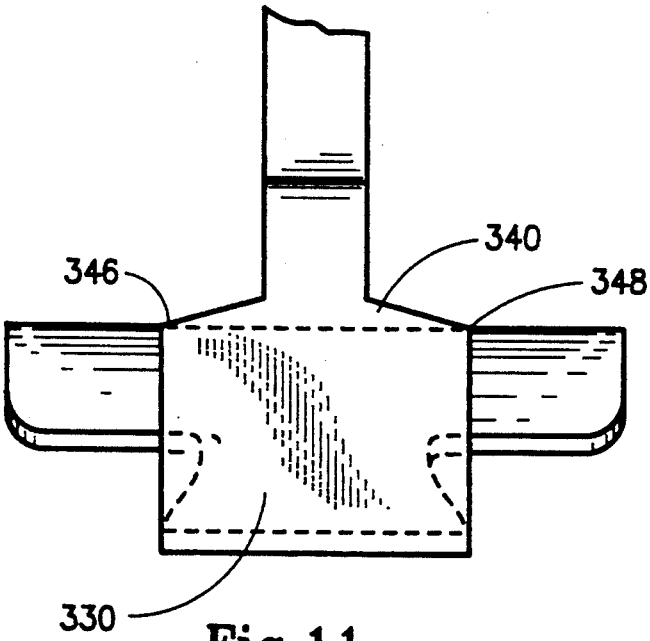
FIG. 11 is a front view in elevation of the clamp arm and nose portion shown in FIG. 10.
Figure 12:
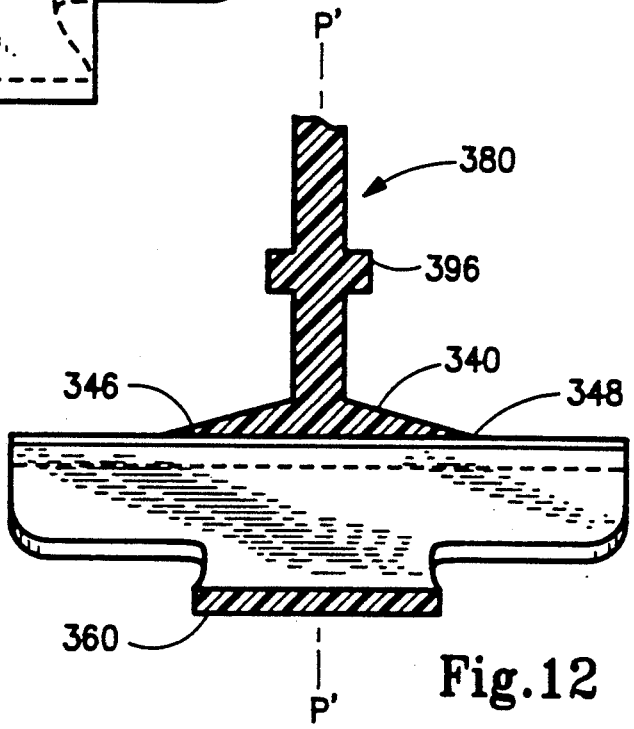
FIG. 12 is a cross-sectional view taken about lines 12—12 of FIG. 10.

Base plate 340 is thus symmetric about divider plane P', shown in FIG. 12, and, as is shown in FIGS. 11 and 12, diminishes in thickness in a direction from the divider panel 390 to each respective side edge 346 and 248. This lateral tapering allows base plate 340 to easily extend under books or other materials placed adjacent thereto for support by divider panel 380. In this embodiment, second pad 406 is mounted in a channel 408 formed in bottom surface 342 of base plate 340.

Figure 13:
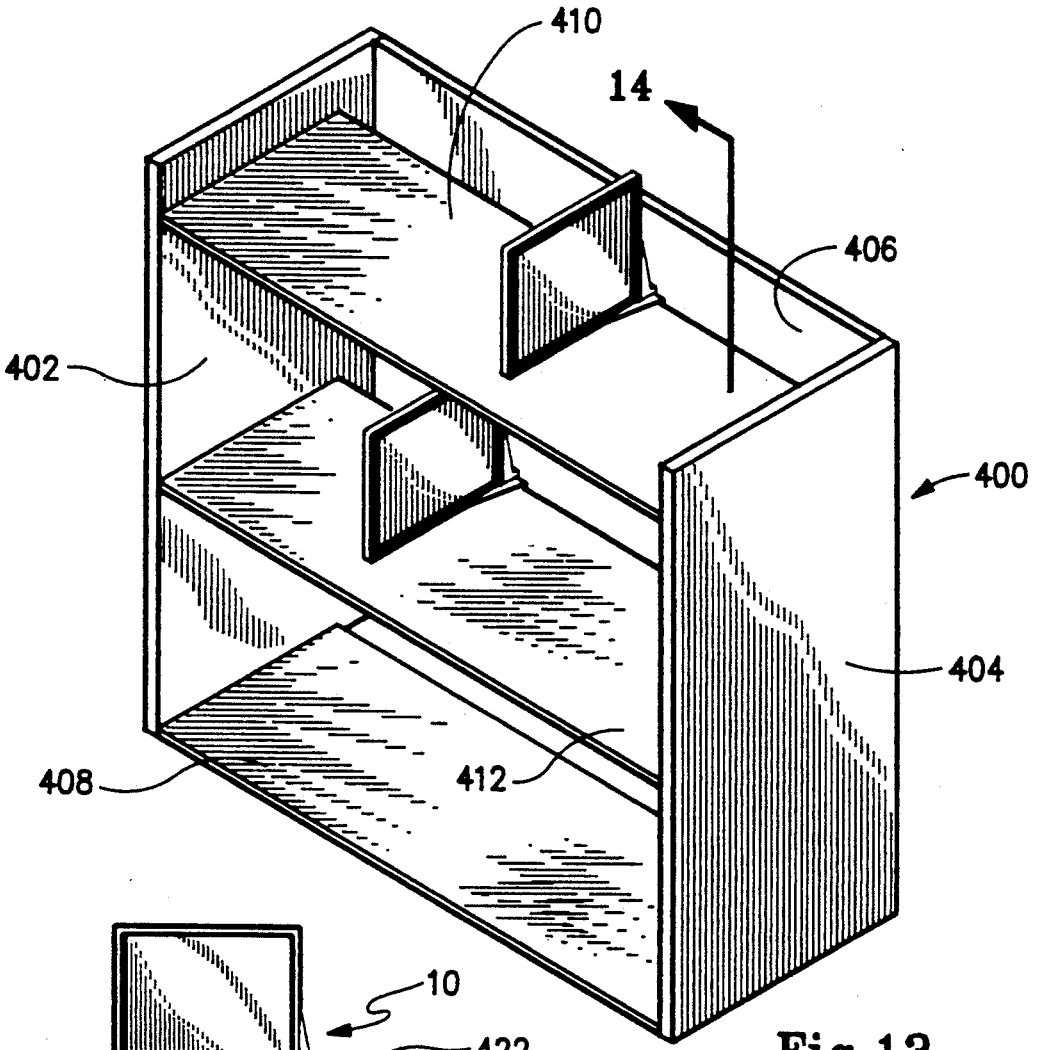
FIG. 13 shows the first exemplary embodiment of the present invention used in conjunction with a specially constructed shelf system according to the present invention.
Figure 14:
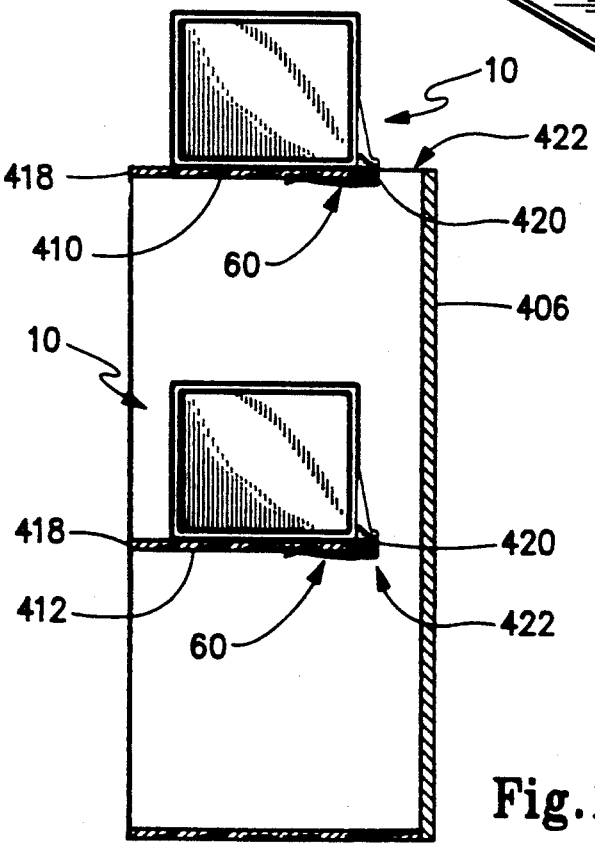
FIG. 14 is a cross-sectional view taken about lines 14—14 of FIG. 13.

Finally, with reference to FIGS. 13 and 14, it may be seen that a special shelving system may be used with the shelf dividers 10, 110, 210 and 310 according with the exemplary embodiments of the present invention. Here, shelf system 400 includes a pair of end panels 402, 404, a back panel 406, a bottom shelf 408, a top shelf 410, and an intermediate shelf 412. Shelf system 400 is generally box-shaped in configuration, but it may be seen in reference to FIG. 14, that each of top shelf 410 and intermediate shelf 412 has an exposed rear edge surface 420 opposite front edge surface 418 that is spaced from back panel 406 to respectively leave gaps 420 therebetween. Gaps 422 are sized to cooperate with the structure, for example, of web portion 30, base plate 40, clamp arm 60 and a front portion of divider panel 80 so that a shelf divider, such as shelf divider 10, may be canted and manipulated into position. The respective clamp arm, such as clamp arm 60 thus engages respective shelf 410, 412 with web portion 30 abutting exposed rearward edge 420. This configuration provides for a neat appearance for organizational system including the shelf dividers according to the preferred embodiments of the present invention and furthermore helps avoid the inadvertent dislodgment of theft of the shelf dividers.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A shelf divider adapted to mount on a shelf which has an upper surface, a lower surface and an exposed edge surface, said shelf divider operative when in a mounted state to support and organize objects located on the shelf, comprising;

(a) a web portion adapted to be positioned against the exposed edge surface of said shelf when in the mounted state, said web portion having upper and lower web edges;

(b) a base plate extending from the upper web edge perpendicularly to said web portion and having a bottom surface adapted to rest on the upper surface of said shelf and a top surface opposite said bottom surface;

(c) a clamp arm extending from the lower web edge in opposed relation to said base plate to terminate in a free-end portion, said clamp arm movable between a closed position wherein said free-end portion is proximate to said base plate and an open position wherein said free-end portion is spaced from said base plate, said clamp arm being biased toward said closed position so that, when in the mounted state, said free-end portion bears against the lower surface of said shelf whereby a portion of said shelf is resiliently clamped between said clamp arm and said base plate;

(d) a relatively flat divider panel connected to an located centrally of said base plate, said divider panel extending perpendicularly to said base plate to define a divider plane that is perpendicular to said web portion, said divider panel having opposite side surfaces and a peripheral edge with said side surfaces adapted to be in facing relationship with the objects on the shelf when in the mounted state; and (e) a first stiffening rib on each of the side surfaces of said divider panel, each said first stiffening rib projecting outwardly from the divider plane and formed integrally with said divider panel, said first stiffening ribs operative to resist deflection of said divider panel when in the mounted state.

2. A shelf divider according to claim 1 wherein said base plate is tapered in thickness as measured between the top and bottom surfaces thereof.

3. A shelf divider according to claim 2 wherein said base plate has a pair of side edges that converge toward one another and terminate proximate said free end portion when said free end portion is in the closed position.

4. A shelf divider according to claim 2 wherein said divider panel has a forward edge portion and a rearward edge portion opposite said forward edge portion and wherein said base plate has a pair of side edges that converge toward one another and terminate proximate to said rearward edge portion.

5. A shelf divider according to claim 2 wherein said base plate has side edges that are symmetric about the divider plane and wherein said base plate diminishes in thickness from said divider panel to each of said side edges.

6. A shelf divider according to claim 5 wherein said divider panel has a forward edge portion and a rearward edge portion opposite said forward edge portion, said base plate extending along a lowermost portion of said divider panel completely from said forward edge portion to said rearward edge potion.

7. A shelf divider according to claim 1 wherein each said first stiffening rib extends around the periphery of said divider panel.

8. A shelf divider according to claim 7 including a second stiffening rib on each of the side surfaces of said divider panel, each said second stiffening rib being spaced-apart from its respective said first stiffening rib, said second stiffening ribs each bounding an uninterrupted side surface area.

9. A shelf divider according to claim 7 wherein said divider panel has a nose portion proximate to said web portion, said nose portion having an increased thickness as measured in a direction perpendicular to the divider plane.

10. A shelf divider according to claim 1 including a pair of stiffening ribs on each said side surface, each member of said pair intersecting one another at a central portion thereof.

11. A shelf divider according to claim 1 wherein said divider panel has forward edge portion, a rearward edge portion and a lowermost portion and including a pad of anti-skid material on said lowermost portion, said pad being positioned such that it contacts the upper surface of said shelf when in the mounted state.

12. A shelf divider according to claim 1 including a pad of anti-skid material on said free end portion, of said clamp arm, said pad being positioned such that is contacts the lower surface of said shelf when in the mounted state.

13. A shelf divider according to claim 1 wherein said divider panel has a forward edge portion, a rearward edge portion and a lowermost portion and including a first pad of anti-ski material of said free-end portion of said clamp arm and a second pad of anti-skid material on said lowermost portion, said first pad being positioned such that it contacts the lower surface of said shelf when in the mounted state and said second pad being positioned such that it contacts the upper surface of said shelf when in the mounted state.

14. A shelf divider according to claim 1 wherein said free-end portion of said clamp arm includes lateral wing portion projecting oppositely one another on either side of said divider plane so that said free-end portion has a width that is greater than the width of said web portion as measured in a direction perpendicular to said divider plane.

15. A shelf divider according to claim 1 wherein said clamp arm has a first arm portion proximate to said web portion that has a positive radius of curvature and wherein said free-end portion has a negative radius of curvature, each as measured with respect to said base plate, so that said clamp arm has a flattened S-shaped configuration.

16. A shelf divider adapted to mount on a shelf which has an upper surface, a lower surface and an exposed edge surface, said shelf divider operative when in a mounted state to support and organize objects located on the shelf, comprising;

(a) a web portion adapted to be positioned against the exposed edge surface of said shelf when in the mounted state, said web portion having upper and lower web edges and a web width along the exposed edge surface in the mounted state;

(b) a base plate extending from the upper web edge perpendicularly to said web portion and having a bottom surface adapted to rest on the upper surface of said shelf and a top surface opposite said bottom surface and having a thickness that is tapered as measured between the top and bottom surfaces thereof;

(c) a clamp arm extending from the lower web edge in opposed relation to said base plate to terminate in a free-end portion, said clamp arm movable between a closed position wherein said free-end portion is proximate to said base plate and an open position wherein said free-end portion is spaced from said base plate, said clamp arm being biased toward said closed position so that, when in the mounted state, said free-end portion bears against the lower surface of said shelf whereby a portion of said shelf is resiliently clamped between said clamp arm and said base plate, said free-end portion of said clamp arm including lateral wing portion projecting oppositely one another on either side of said divider plane so that said free-end portion has a width that is greater than the web width;

(d) a relatively flat divider panel connected to and located centrally of said base plate, said divider panel extending perpendicularly to said base plate to define a divider plane that is perpendicular to said web portion, said divider panel having opposite side surfaces and a peripheral edge with said side surfaces adapted to be in facing relationship with the objects on the shelf when in the mounted state; and (e) a first stiffening rib on each of the side surfaces of said divider panel, each said first stiffening rib projecting outwardly from the divider plane and formed integrally with said divider panel, said first stiffening ribs operative to resist deflection of said divider panel when in the mounted state.

17. A combination shelf and shelf divider system, comprising:

a shelf system including a plurality of shelf elements supported relative to a back wall in such a manner that a gap of selected depth is created between an exposed back edge surface of at least some of said shelf elements and said back wall; and a plurality of shelf dividers each having a clip structure including a web portion, a base plate, a clamp arm and a divider panel formed integrally with one another and dimensioned so that each said shelf divider may be manipulated to abut the web portion thereof against the exposed back edge surface of a respective shelf with a marginal portion of said shelf adjacent the back edge surface being clamped between the base plate and clamp arm thereof and with said divider panel extending forwardly of said back edge surface along an upper surface of the shelf.

* * * * *